US008293032B2

(12) United States Patent
Horimura et al.

(10) Patent No.: US 8,293,032 B2
(45) Date of Patent: Oct. 23, 2012

(54) TITANIUM ALLOY BOLT AND ITS MANUFACTURING PROCESS

(75) Inventors: Hiroyuki Horimura, Wako (JP); Kosuke Doi, Wako (JP); Hideaki Sumitomo, Nagoya (JP)

(73) Assignees: Honda Motor Co., Ltd., Tokyo (JP); Meira Co., Ltd., Nagoya-Shi (JP)

( * ) Notice: Subject to any disclaimer, the term of this patent is extended or adjusted under 35 U.S.C. 154(b) by 345 days.

(21) Appl. No.: 11/391,463

(22) Filed: Mar. 29, 2006

(65) Prior Publication Data

US 2006/0234800 A1 Oct. 19, 2006

(30) Foreign Application Priority Data

Mar. 30, 2005 (JP) ..... P2005-097830

(51) Int. Cl.
*C22F 1/18* (2006.01)

(52) U.S. Cl. ..... 148/421; 420/417

(58) Field of Classification Search ..... 420/417; 148/421

See application file for complete search history.

(56) References Cited

U.S. PATENT DOCUMENTS

| | | | | | |
|---|---|---|---|---|---|
| 3,532,560 | A | * | 10/1970 | Tomioka et al. | 148/599 |
| 4,886,559 | A | * | 12/1989 | Shindo et al. | 148/421 |
| 5,634,751 | A | * | 6/1997 | Stencel et al. | 411/43 |
| 6,063,211 | A | * | 5/2000 | Soeda et al. | 148/421 |

FOREIGN PATENT DOCUMENTS

| | | | |
|---|---|---|---|
| JP | 1-252747 | A | 10/1989 |
| JP | 2982579 | B2 | 9/1999 |

* cited by examiner

*Primary Examiner* — Jie Yang
(74) *Attorney, Agent, or Firm* — Birch, Stewart, Kolasch & Birch, LLP

(57) ABSTRACT

A process which can make a titanium alloy bolt at ambient temperature is disclosed. A Ti—Fe—O alloy is used as a material. It has a screw thread formed thereon by drawing and rolling.

4 Claims, 4 Drawing Sheets

TITANIUM ALLOY BOLT AND ITS MANUFACTURING PROCESS

FIELD OF THE INVENTION

The present invention relates to a titanium alloy bolt and a process for manufacturing the same.

BACKGROUND OF THE INVENTION

A steel bolt is mainly employed as a bolt which is a typical fastening member. A titanium alloy bolt is employed when a weight reduction or higher strength is required. A titanium alloy bolt requires a higher level of art for its manufacture than a steel bolt does. Art for manufacturing a titanium alloy bolt is proposed in, for example, Japanese Patent No. 2,982,579. The titanium alloy bolt disclosed in Japanese Patent No. 2,982,579 is manufactured from a Ti (titanium)-6% Al (aluminum)-4% V (vanadium) alloy.

The Ti-6% Al-4% V alloy is an alpha-beta alloy which is manufactured by adding an alpha-stabilizing element and a beta-stabilizing element to titanium. The alpha-beta alloy is difficult to work on at room temperature because of its high deformation resistance and low stretch ability. Hot forging performed at a high temperature is, therefore, employed for shaping an alpha-beta alloy by forging, since holding it at a high temperature lowers its deformation resistance and makes it easier to stretch.

However, a product of hot forging at a high temperature is seriously affected by the thermal expansion of the alloy. As a result, the forged product is undesirably low in dimensional accuracy. It is necessary to design a product of hot forging with a sufficiently thick cutting allowance for making up its low dimensional accuracy and a waste of the material is, therefore, inevitable.

The hot forging of a titanium material forms scale and oxide layers on its surface as its heavy oxidation takes place at a high temperature. The necessity for the removal of the scale and oxide layers adds to the cost of bolt manufacture.

Moreover, hot forging requires heat energy for heating the material to a high temperature.

On the other hand, cold forging can make a product close to a final product in shape, since it does not require any heat energy, or cause any lowering in dimensional accuracy that would result from thermal expansion.

Accordingly, it has been necessary to explore a titanium material which can be substituted for the alpha-beta alloy and is suitable for cold forging, and there have been proposed pure titanium and a beta titanium alloy as titanium materials to which cold forging is applicable.

Pure titanium is, however, too low in strength as a material for bolts of which high strength is required. The beta titanium alloy contains a by far larger amount of expensive material than the alpha-beta titanium alloy does, and it has a high deformation resistance. The necessity for a large amount of expensive material results in an expensive bolt and its high deformation resistance shortens the life of a die assembly. For these reasons, neither pure titanium nor the beta titanium alloy can be considered as a suitable material for bolts.

Therefore, it has been necessary to develop a titanium alloy bolt which can be manufactured by cold forging as a substitute for a bolt of pure titanium or a beta titanium alloy.

SUMMARY OF THE INVENTION

According to a first aspect of the present invention, there is provided a titanium alloy bolt made of a Ti—Fe—O (titanium-iron-oxygen) alloy, having a tensile strength of at least 800 MPa and having a screw thread formed on its appropriate portion by drawing and rolling.

The Ti—Fe—O alloy is capable of drawing and rolling at ambient temperature to make a bolt of high dimensional accuracy.

A round bar of the alloy made by rolling is used as a material for a bolt. The round bar has roll marks formed at the time of rolling and serving to increase its tensile strength. The roll marks are not broken when a screw thread is formed by drawing and rolling. The roll marks remaining on a titanium alloy bolt add to its strength. The titanium alloy bolt has a tensile strength of at least 800 MPa which is a sufficiently high level of strength for the bolt.

The titanium alloy preferably has an iron content of 0.6 to 1.4% by mass and an oxygen content of 0.24 to 0.44% by mass, the balance of its composition being titanium and unavoidable impurities. It more preferably contains 0.05% by mass or less of nitrogen substituted for a part of its oxygen.

If the alloy is of the composition as set forth above, its titanium may be nonstandard spongy titanium. The nonstandard material is less expensive and more easily available than a standard material. A remarkable reduction in the cost of materials makes it possible to provide a low-priced titanium alloy bolt.

According to a second aspect of the present invention, there is provided a process for manufacturing a titanium alloy bolt having a tensile strength of at least 800 MPa, which comprises the steps of preparing a blank of a titanium-iron-oxygen alloy, subjecting the blank to cold plastic working at ambient temperature and forming a screw thread on a product of plastic working.

The Ti—Fe—O alloy allows plastic working at ambient temperature and thereby a reduction in the cost of working. Its working at ambient temperature can make a product close to a final product in shape and thereby enables the effective use of the material.

The screw thread is preferably formed by rolling. Rolling leaves on a bolt roll marks which strengthen it.

The process preferably includes a heat treatment step for annealing a product of cold plastic working at a temperature of 400° C. to 600° C. before forming a screw thread thereon. This annealing reduces or removes any strain produced on the product of cold plastic working.

The process preferably includes a surface treatment step for barrel polishing the annealed product.

Its barrel polishing makes it possible to control the surface roughness of the product. This is particularly important as bolts having a unified surface roughness on the flanges of their bolts can be tightened with a unified amount of torque.

The annealing is preferably performed in the open air.

The annealing at a temperature of 600° C. or lower brings about only a slight reduction in fatigue strength of the bolt, if any. Therefore, such annealing is possible in the open air and annealing in the open air is less expensive than in an argon gas atmosphere or in a vacuum.

The cold plastic working step preferably includes a step for drawing the product of plastic working along its portion on which the screw thread will be formed, so that an area reduction ratio expressed by the formula [(Cross-sectional area of the portion still to be drawn−Cross sectional area of the portion as drawn)/Cross-sectional area of the portion still to be drawn] may be from 10 to 70%.

An area reduction ratio of 10% or higher ensures a satisfactory improvement in strength by drawing and an area reduction ratio of 70% or lower ensures that no portion of the product of plastic working be seized by the die assembly when it is drawn.

BRIEF DESCRIPTION OF THE DRAWINGS

Certain preferred embodiments of the present invention will now be described in detail, by way of example only, with reference to the accompanying drawings, in which.

DETAILED DESCRIPTION OF THE PREFERRED EMBODIMENTS

A blank for a titanium alloy bolt according to the present invention is preferably of a Ti—Fe—O alloy preferably having an iron content of 0.6 to 1.4% by mass and an oxygen content of 0.24 to 0.44% by mass, the balance of its composition being titanium and unavoidable impurities, and more preferably of a Ti—Fe—O—N alloy containing 0.05% by mass or less of nitrogen substituted for a part of its oxygen.

The blank is preferably a round wire rod prepared by a process including, for example, steps for making an ingot, forging the ingot into an appropriate size, hot rolling it, cold rolling it into a wire rod and annealing it. The wire rod is preferably coiled for easier transportation.

Figure 1A:
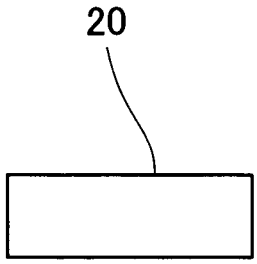
FIGS. 1A to 1C are a series of diagrams showing the cold plastic working step of a process embodying the present invention.
Figure 1B:
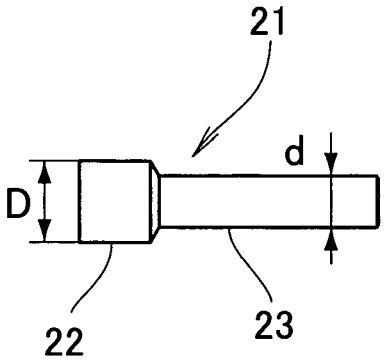

The plastic working of a blank at ambient temperature will now be described with reference to FIGS. 1A to 1C. A blank 20 is prepared as shown in FIG. 1A by cutting a round wire rod to an appropriate length. The blank 20, except its portion which will form the head of a bolt, is drawn into a smaller diameter to form a drawn product 21 having a shank portion as shown in FIG. 1B.

Its drawing is performed to form the shank portion before a screw thread is formed thereon. The shank portion on which a screw thread will be formed is drawn so that an area reduction ratio expressed by the formula [(Cross-sectional area of the portion still to be drawn−Cross-sectional area of the portion as drawn)/Cross-sectional area of the portion still to be drawn] may be from 10 to 70%.

An area reduction ratio of 10% or higher ensures a satisfactory improvement in strength by drawing and an area reduction ratio of 70% or lower ensures that no portion of the product of plastic working be seized by the die assembly when it is drawn.

The drawn product 21 has a large diameter portion 22 having a diameter shown as D and the shank portion 23 having a diameter shown as d. Accordingly, the area reduction ratio can be expressed as $(D^2-d^2)/D^2$.

Figure 1C:
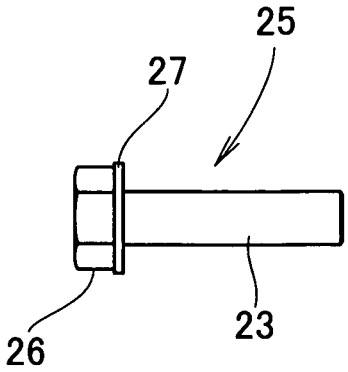

The drawn product 21 is subjected to heading and upset forging to have its large diameter portion 22 shaped to form a headed shank member 25 as shown in FIG. 1C.

The headed shank member 25 has a bolt head 26 having a flange 27 and formed at one end of the shank portion 23 as an integral part thereof.

The heat and surface treatment of the headed shank member 25 will now be described by way of example with reference to FIGS. 2A to 2C.

Figure 2A:
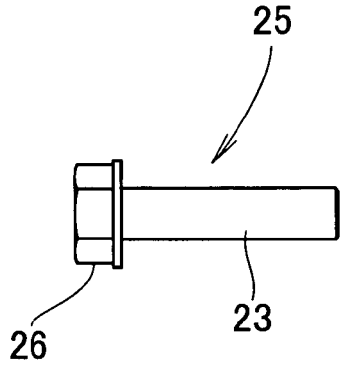
FIGS. 2A to 2C are a series of diagrams showing the heat and surface treatment steps of the process.
Figure 2B:
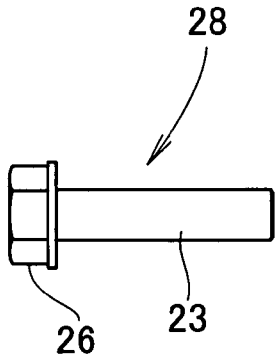

The headed shank member 25 as shown in FIG. 2A is placed in an annealing apparatus and annealed at a temperature of 400° C. to 600° C. in the atmosphere to make an annealed shank member 28 as shown in FIG. 2B.

The headed shank member 25 has strain produced in the blank by its cold plastic working as described before with reference to FIGS. 1A to 1C. Its strain is reduced or removed by annealing. Its annealing is particularly effective for reducing any stress remaining in the boundary between the shank portion 23 and the bolt head 26 and thereby preventing the fracture of the bolt in the boundary between its shank portion 23 and its head 26. Moreover, its annealing improves its proof stress by 0.2%. Even an alloy having a lower ration of proof stress to tensile strength than any known alloy (e.g. Ti64) and failing to satisfy the standard for bolts can be modified to conform to the standard for bolts by annealing.

Figure 2C:
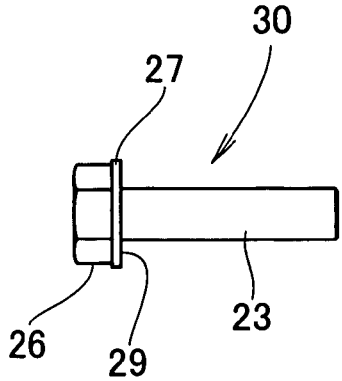

The annealed shank member 28 is barrel polished to give a polished shank member 30 as shown in FIG. 2C. Barrel polishing is a method in which the annealed shank member 28 and a granular polishing material are put in a barrel containing, and by shaking or rotating the barrel, the polishing material is brought into contact with the annealed shank member 28. The surface roughness of the polished shank member 30 can be controlled by altering the particle size of the polishing material, the shape of its particles, its quality and the duration of the treatment.

The polished shank member 30 has its surface finished with a desired roughness. The roughness of the surface 29 of the flange 27 is of particular importance. When its "maximum height roughness Rz" as specified by JIS B0601:2001 is conveniently adopted as its surface roughness, the surface roughness of the flange 27 which is about 10 μm before the barrel polishing is improved to a level of about 3 μm or less.

The improved roughness of the surface 29 of the flange 27 makes it possible to realize a unified bolt tightening torque. The bolt head 26 also has an improved surface roughness adding to the commercial value of the bolt.

The step for forming a screw thread on the polished shank member 30 will now be described by way of example with reference to FIGS. 3A to 3C. The screw thread can be formed by a method such as rolling, grinding or cutting.

Rolling is the art of pressing a rolling die against the shank portion 23 to form a screw thread thereon.

Thread grinding is the art of grinding the shank portion 23 with a grinding wheel to form a screw thread thereon.

Thread cutting is the art of cutting the shank portion 23 with a cutting tool, such as a turning or milling tool, to form a screw thread thereon.

Figure 3A:
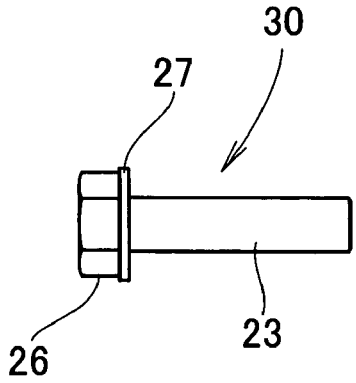
FIGS. 3A to 3C are a series of diagrams showing the screw thread forming step of the process.
Figure 3B:
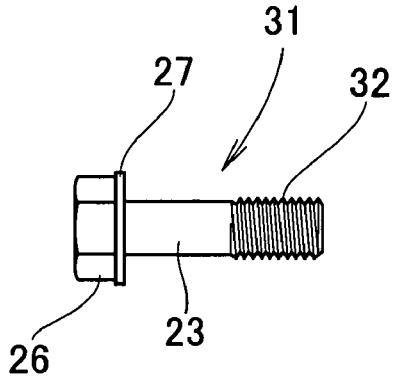

When a screw thread is formed by rolling on the shank portion 23 of the polished shank member 30 as shown in FIG. 3A, there is produced a titanium alloy bolt 31 as shown in FIG. 3B. The titanium alloy bolt 31 has its screw thread 32 formed along a part of its shank portion 23. The screw thread 32 may alternatively be formed along the entire length of the shank portion 23.

When the screw thread is formed by rolling, the bolt is improved in strength owing to the roll marks remaining all intact thereon and the residual stress imparted to the bottoms of the screw thread where the fracture of the bolt is usually likely to start. It is possible to improve a tensile strength of the bolt into 800 MPa or higher when the screw thread is formed by rolling even on a material having a lower tensile strength.

Moreover, the screw thread formed by rolling is defined by uniformly formed ridges and grooves and therefore has a stabilized coefficient of friction, since its ridges and grooves are formed merely by pressing a rolling die against the bolt material.

Figure 3C:
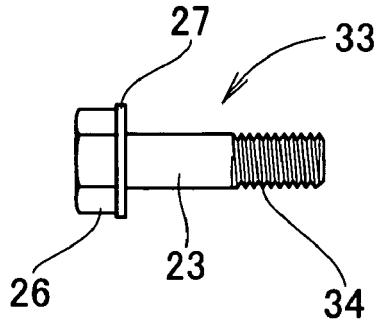

When a screw thread is formed by grinding or cutting on the shank portion 23 of the polished shank member 30 as shown in FIG. 3A, there is produced a titanium alloy bolt 33 as shown in FIG. 3C. The titanium alloy bolt 33 has its screw thread 34 formed along a part of its shank portion 23. The screw thread 34 may alternatively be formed along the entire length of the shank portion 23.

Figure 4:
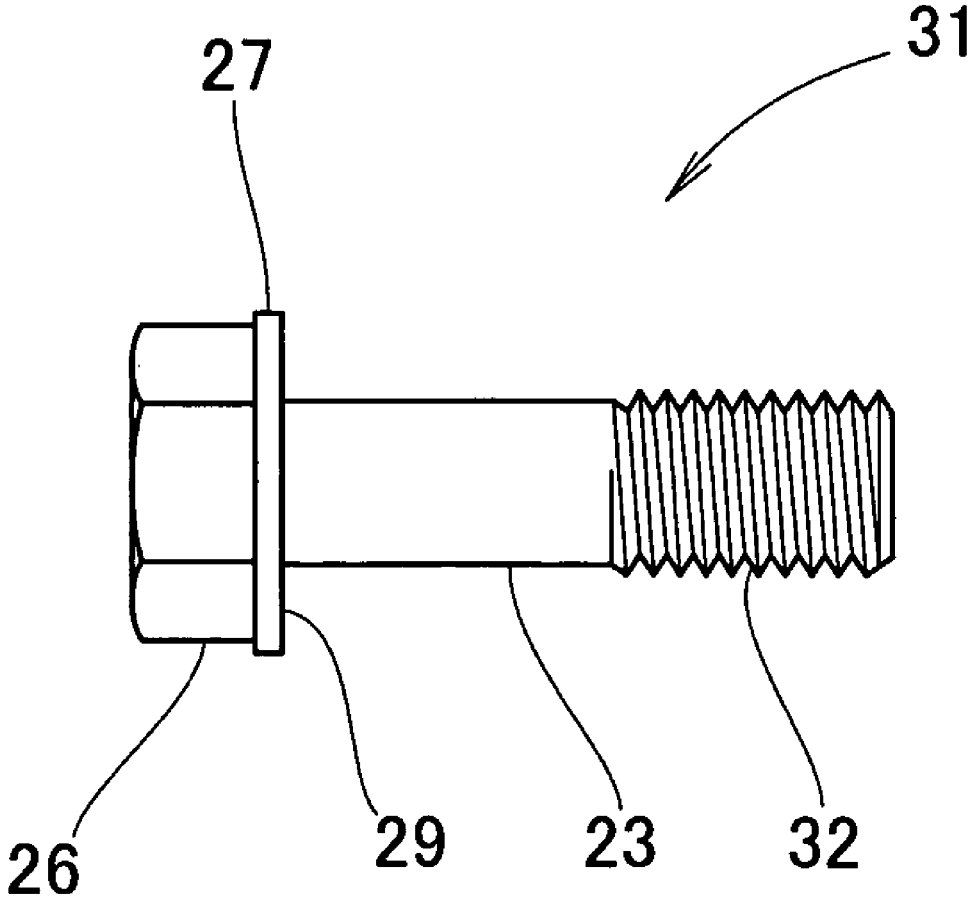
FIG. 4 is an enlarged elevational view of a titanium alloy bolt embodying the present invention.

According to the manufacture method as described above, the titanium alloy bolt 31 as shown FIG. 4 can be obtained. The titanium alloy bolt 31 has its screw thread 32 formed along a part of its shank portion 23 (or along the entire length thereof) having the head 26 having a flange 27 on the other end thereof.

The titanium alloy bolt 31 is made of a Ti—Fe—O alloy and has a tensile strength of at least 800 MPa which is achieved by the plastic working and annealing of the alloy as described.

Obviously, various minor changes and modifications of the present invention are possible in the light of the above teaching. It is therefore to be understood that within the scope of the appended claims the invention may be practiced otherwise than as specifically described.

What is claimed is:

1. A titanium alloy bolt having a head and a portion to be threaded and extending from the head, the bolt being made of a Ti—Fe—O (titanium-iron-oxygen) alloy, having a tensile strength of at least 800 MPa, and having a screw thread formed on a portion thereof, wherein the Ti—Fe—O alloy is a composition consisting of iron content of 0.6% by mass, and a combined oxygen content and nitrogen content of 0.24 to 0.44% by mass, with the nitrogen content substituting for up to 0.05% by mass of the oxygen content, the balance of the composition being titanium and unavoidable impurities, wherein the bolt includes a larger diameter portion with diameter D and a shank portion having a diameter d, wherein a relationship between the diameter D and the diameter d is expressed by a formula $(D^2-d^2)=0.1\times D^2$, wherein the threaded portion includes bolt roll marks.

2. A titanium alloy bolt as set forth in claim 1, wherein the alloy bolt a cold-forged grain structure having defects and dislocations.

3. A titanium alloy bolt having a head and a portion to be threaded and extending from the head, the bolt being made of a Ti—Fe—O (titanium-iron-oxygen) alloy, having a tensile strength of at least 800 MPa, and having a screw thread formed on a portion thereof, wherein the Ti—Fe—O alloy is formed of a composition consisting of iron content of 0.6 to 1.4% by mass, and a combined oxygen content and nitrogen content of 0.44% by mass, with the nitrogen content substituting for up to 0.05% by mass of the oxygen content, the balance of the composition being titanium and unavoidable impurities, wherein the bolt includes a larger diameter portion with diameter D and a shank portion having a diameter d, wherein a relationship between the diameter D and the diameter d is expressed by a formula $(D^2-d^2)=0.7\times D^2$, wherein the threaded portion includes bolt roll marks.

4. A titanium alloy bolt as set forth in claim 3, wherein the alloy bolt a cold-forged grain structure having defects and dislocations.

* * * * *